US005689083A

United States Patent [19]

Hadden

[11] Patent Number: 5,689,083

[45] Date of Patent: Nov. 18, 1997

[54] OBTURATING INITIATION FITTING

[75] Inventor: William C. Hadden, Springfield, Mass.

[73] Assignee: The Ensign-Bickford Company, Simsbury, Conn.

[21] Appl. No.: 647,336

[22] Filed: May 9, 1996

[51] Int. Cl.[6] ..... C06C 5/00

[52] U.S. Cl. ..... 102/275.2; 102/275.5; 102/275.11; 102/275.12

[58] Field of Search ..... 102/275.2, 275.3, 102/275.4, 275.5, 275.6, 275.7, 275.11, 275.12

[56] References Cited

U.S. PATENT DOCUMENTS

| | | | |
|---|---|---|---|
| 3,326,127 | 6/1967 | Schimmel | 102/275.2 |
| 3,460,477 | 8/1969 | Heidemann et al. | 102/275.2 |
| 4,038,900 | 8/1977 | Lopez | 102/275.5 |
| 4,328,753 | 5/1982 | Kristensen et al. | 102/275.5 |
| 4,423,682 | 1/1984 | Schimmel | 102/275.2 |
| 4,612,857 | 9/1986 | Schimmel | 102/275.2 |
| 4,664,033 | 5/1987 | Burkdoll et al. | 102/275.2 |
| 4,742,773 | 5/1988 | Bartholomew et al. | 102/275.3 |
| 4,770,099 | 9/1988 | Brede et al. | 102/275.7 |
| 5,171,935 | 12/1992 | Michna et al. | 102/275.7 |
| 5,179,249 | 1/1993 | Bement et al. | 102/275.11 |
| 5,216,197 | 6/1993 | Huber et al. | 102/275.2 |
| 5,365,851 | 11/1994 | Shaw | 102/275.11 |
| 5,417,162 | 5/1995 | Adams et al. | 102/275.11 |

*Primary Examiner*—Michael J. Carone
*Assistant Examiner*—Theresa M. Wesson
*Attorney, Agent, or Firm*—Victor E. Libert; Frederick A. Spaeth

[57] ABSTRACT

An initiation fitting (10) includes a sleeve member (12) having a first end to which a fuse (18) or other initiator is connected and a second end to which an initiating charge (38) is connected for initiating a connected device such as a rocket motor and to hinder the venting of gases from the device through the fitting (10). The sleeve member (10) includes an internal passage (14) extending therethrough and a malleable internal flange (48) which protrudes into the internal passage (14). The internal flange (48) is dimensioned and configured so that when the initiating charge (38) detonates, the internal flange (48) collapses into the internal passage (14) to hinder the flow therethrough of explosive gases from the second end of the fitting.

6 Claims, 5 Drawing Sheets

OBTURATING INITIATION FITTING

FIELD OF THE INVENTION

This invention relates to initiation fittings that are designed to be secured to devices that comprise explosive, deflagrating or other similarly reactive materials, for initiating the reactive material in such devices.

RELATED ART

U.S. Pat. No. 4,664,033 to Burkdoll et al, dated May 12, 1987, discloses an explosive initiator that comprises a cylindrical body (11) having an axial bore therethrough. The cylindrical body has an inlet port (16) for receiving a signal transmission tube or fuse (19) and a chamber (18) within which a propellant charge (22) is disposed. Between the inlet port (16) and the chamber (18) there is a valve to prevent substantially all reaction products from passing from the chamber (18) into the hollow interior of the fuse (19). The initiator can therefore transfer a signal in only one direction, from the fuse to the chamber. The valve comprises a ball member (33) disposed in a conical or spherical valve seat (34) which acts as a check valve or stopcock to prevent the backflow of gases into the signal tube. The valve seat (34) is more narrow at points closer to the inlet port (16) than to chamber (18).

U.S. Pat. No. 4,770,099 to Brede et al, dated Sep. 13, 1988, discloses a propellant charge igniter for cartridge-type ammunition. The igniter comprises two sections (2), each of which contains a plurality of igniter charges (5). The sections (2) are held together by a connecting tube (3). The device includes a bottom screw (1) which includes a center pole (11) through which the igniter is electrically fired. As can be seen in FIG. 6, the bottom screw comprises a sealing element (53). When the igniter is fired, the sealing element prevents the escape of gases through the bottom screw (see column 11, line 42 through column 12, line 13). However, unlike the present invention, sealing element (53) is not a collapsible ferrule that is open prior to firing the device. Instead, it bears against the internal structure of the screw prior to firing, and the pressure of gases released upon initiation merely press sealing element (53) more tightly against those structures. In addition, there does not appear to be any passageway through which a tube-type signal could pass.

SUMMARY OF THE INVENTION

The present invention relates to an obturating initiation fitting. The fitting comprises a sleeve member that has a first end and a second end and that defines an internal passage extending therethrough from the first end to the second end. The sleeve member is dimensioned and configured to be secured to a connected device. An initiating charge is disposed in the internal passage for producing an initiation signal comprising a signal-initiating shock wave and a pressure pulse of explosive gases. An initiation means is disposed at the first end of the sleeve member for initiating the initiating charge, and there is an obturating means for hindering the passage of the pressure pulse of explosive gases from the initiating charge to the first end of the sleeve member.

According to one aspect of the invention, the obturating means may be bi-directional with respect to the signal-initiating shock wave of the initiating charge.

In a particular embodiment, the obturating means may comprise a malleable flange in the sleeve member. The flange may have a closure surface and may protrude into the interior passage where the initiating charge is in juxtaposition with the closure surface. The flange may be dimensioned and configured to collapse into the internal passage in response to detonation of the initiating charge, to hinder the flow of the pressure pulse of explosive gases through the fitting.

According to various other aspects of the invention, the fitting may further comprise delay means between the initiation means and the initiating charge, for delaying the initiation of the initiating charge. The initiation means may comprise a signal transmission tube having a proximal end secured to the first end of the sleeve member. Alternatively, the initiation means may comprise a percussion cap or an electric bridgewire.

DETAILED DESCRIPTION OF THE INVENTION AND PREFERRED EMBODIMENTS THEREOF

The present invention relates to an obturating initiation fitting designed to be secured to a connected device. The fitting generally comprises a sleeve member having a first end and a second end, the second end being engaged by the connected device. The sleeve member defines an internal passage therethrough and there is an explosive primary charge, the "initiating charge", at the second end. Upon detonation, the initiating charge produces a shock wave and a pressure pulse of explosive gases. The shock wave is capable of initiating the connected device. The sleeve member is secured to an initiation device for detonating the initiating charge; the initiation device may also be sensitive to the detonation of the initiating charge. The fitting comprises obturating means such as a malleable flange in the sleeve member to hinder the flow of the pressure pulse of explosive gases from the initiating charge to the first end of the sleeve member. By hindering the flow of explosive gases through the sleeve member, the fitting of the present invention helps prevent damage to the initiation device and to other devices or personnel situated nearby and reduces energy losses in the initiation of the connected device that would otherwise be caused by the escape of gaseous explosive products. The fitting therefore finds utility as a connector for securing a variety of initiation devices to any number of connected devices such as aircraft ejection seats, aeronautical release joints, rocket motors, etc. Advantageously, the fitting may permit the passage of the shock wave from the initiating charge to the initiation means, i.e., from the first end of the fitting to the second end, to initiate a signal in the initiation means before the obturating means hinders the travel of the pressure pulse therethrough.

Figure 1:
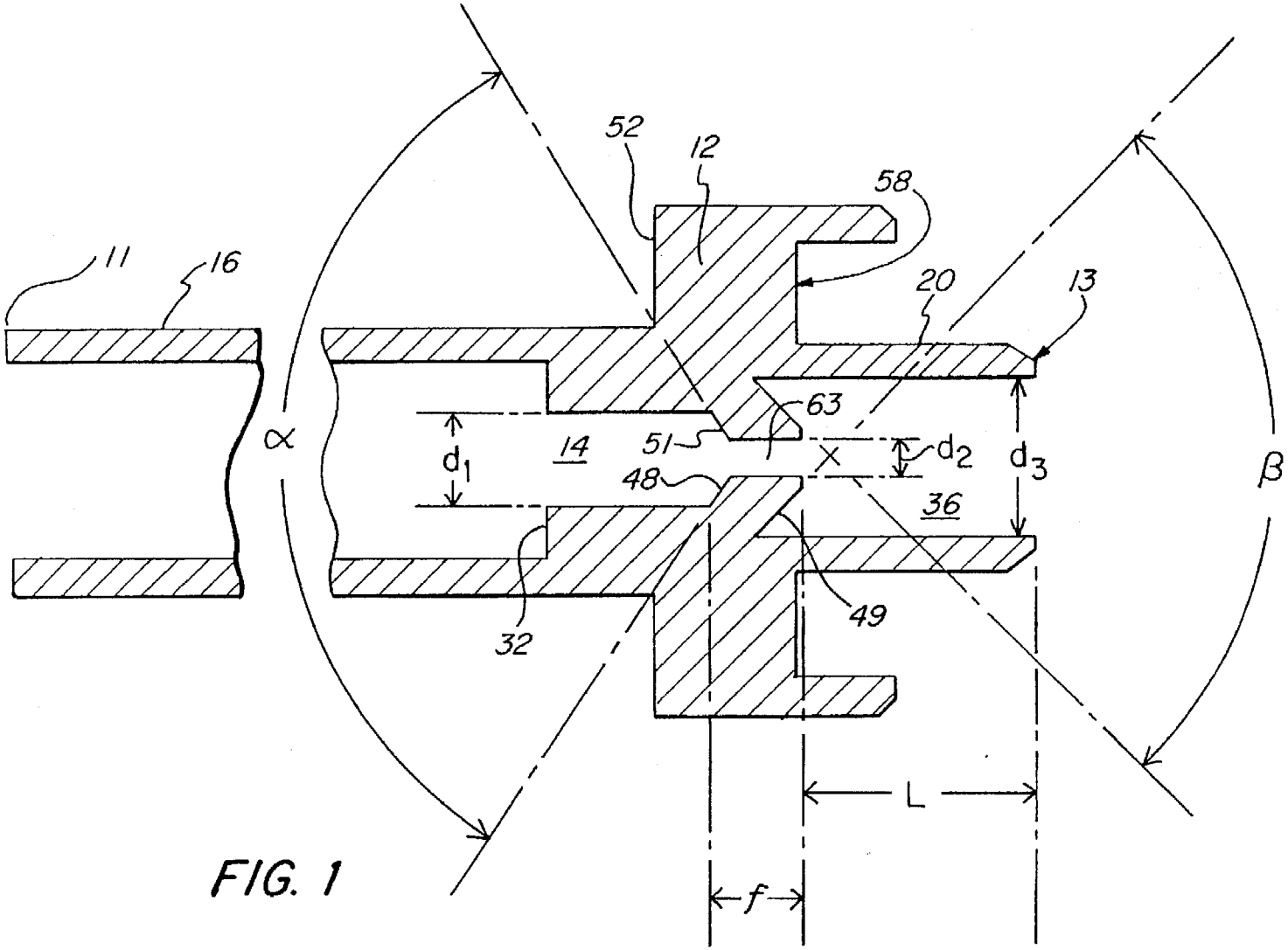
FIG. 1 is a cross-sectional view of a sleeve member for use in an obturating initiation fitting in accordance with one embodiment of the present invention.

A sleeve member for an obturating initiation fitting in accordance with one embodiment of the present invention is shown in FIG. 1. Sleeve member 12 is generally cylindrical in configuration in that it has two ends, a first end 11 and a second end 13, and it defines an internal passage 14 that extends from one end of the sleeve member to the other. In the illustrated embodiment, obturating means is provided by a generally funnel-shaped internal flange 48 (described more fully below) that protrudes into internal passage 14 and that has a convex pressure-bearing surface 49 that is contiguous with a charge cavity 36 on the second end-side of flange 48. Flange 48 defines a flange aperture 63 of internal passage 14.

At first end 11, sleeve member 12 is dimensioned and configured to receive an initiation means such as a signal transmission tube in receiving portion 16. An internal shoulder 32 provides a stop to limit the insertion of a fuse into receiving portion 16. Sleeve member 12 also defines an external shoulder 52 which, as described below, allows sleeve member 12 to be engaged by a connected device to which the fitting will be secured. Sleeve member 12 further defines a bushing shoulder 58 where a sealant bushing can be disposed to engage the connected device when the fitting is secured thereto.

Sleeve member 12 is made from a material such as stainless steel. As shown in FIG. 1, internal flange 48 may be configured to have a generally conical convex pressure-bearing surface 49, and a generally conical concave surface 51 which tapers from left to right (as sensed in viewing FIG. 1) from an internal diameter $d_1$ of about 0.063 to 0.065 inches, i.e., from a diameter $d_1$ of about 0.064 inches, to an internal diameter $d_2$ of about 0.038 to 0.042 inches, or about 0.04 inches, over an internal taper angle $\alpha$ of $118°\pm2°$. In the illustrated embodiment, the flange extends in internal passage 14 for a total length f of 0.050 to 0.055 inches. Internal flange 48 terminates in charge cavity 36 at a distance L of about 0.165 inches from the second end of the sleeve member. Internal flange 48 has an external angle $\beta$ of about $90°\pm2°$ where it protrudes into charge cavity 36. Charge cavity 36 has a diameter $d_3$ from 0.102 to 0.104 inches and is thus designed to contain a charge of 50 milligrams lead azide and 35 milligrams HNS tamped therein at 32 kpsi, which fills charge cavity 36 about flush with the end of sleeve member 12. Of course, a fitting in accordance with the present invention is not limited to these dimensions; the sizes of the charge cavity, the malleable internal flange and other features may be varied to accommodate the characteristics of the connected device.

Figure 2:
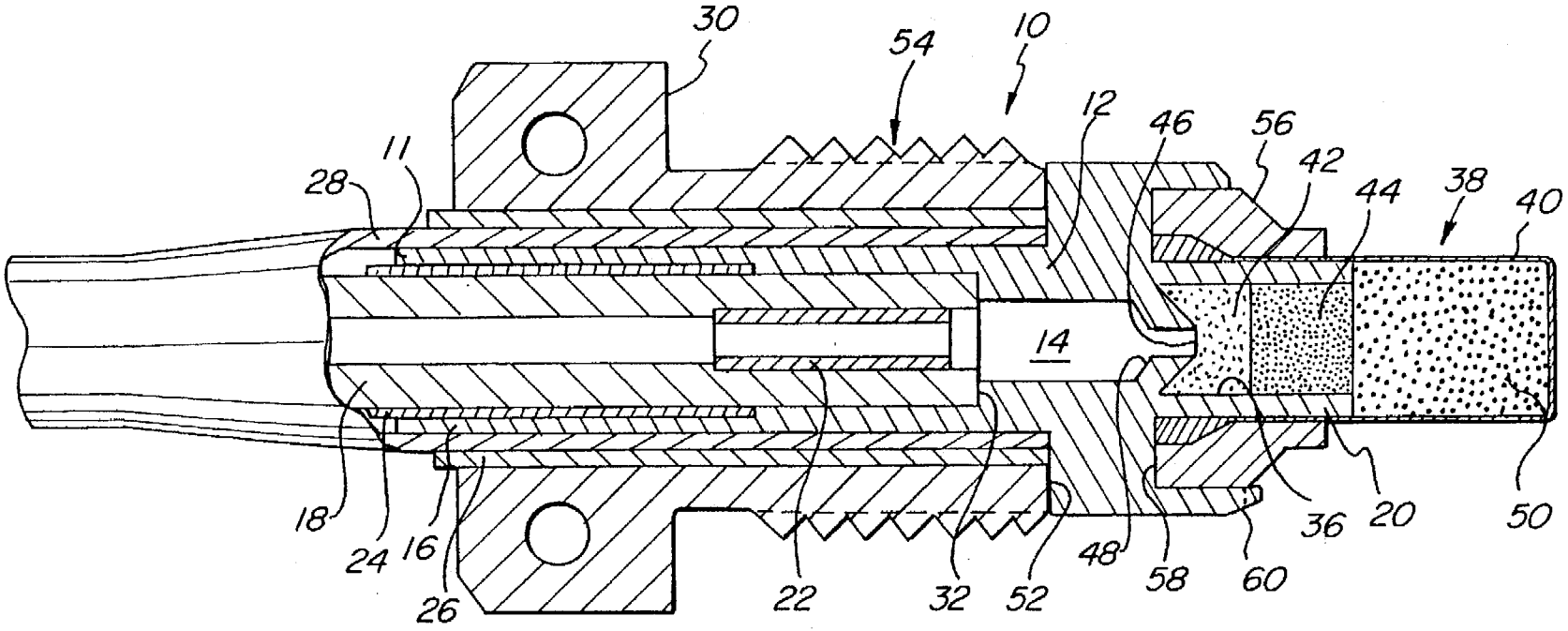
FIG. 2 is a cross-sectional view of an obturating initiation fitting in accordance with one embodiment of the present invention, prior to detonation.

In FIG. 2, an obturating initiation fitting 10 in accordance with one embodiment of the present invention is seen to comprise the sleeve member of FIG. 1. The illustrated initiation means is a signal transmission tube 18 but in alternative embodiments, other initiation devices may be employed, e.g., mild detonating fuse.

A signal transmission tube (occasionally referred to herein simply as a "tube") generally comprises an elongated hollow tube made of one or more synthetic polymeric material(s) ("plastics") containing on the interior wall thereof a coating of reactive material. The coating of reactive material on the interior wall is quite thin and leaves the tube hollow, providing an open channel or bore extending the length of the tube. When the reactant material is ignited, as by a spark ignitor or detonator cap used as a signal-transmitter, or by any other suitable means, ignition of the reactive material propagates an initiation signal through the bore of the tube. The plastic tube may be a plural-layer tube, the inner layer of which may comprise a relatively high tack plastic such as a SURLYN™ ionomer, to which the reactive powder will adhere. The outer tube or tubes may be made of a mechanically tougher material, such as low or medium density polyethylene. Generally, there are two species of signal transmission tube: shock tube and low velocity signal tube. In shock tube, the reactive material is generally a pulverulent explosive of high brisance, such as PETN or HMX and aluminum powder. In low velocity signal tubes, the reactive material is a low velocity deflagrating material instead of an explosive powder of high brisance. The use of a deflagrating material provides a reduced speed of signal transmission through the tube as compared to shock tube. Typical deflagrating materials include manganese/potassium perchlorate, silicon/red lead, and silicon/ferric oxide, to name but a few.

The signal transmission tube secured in sleeve member 12 is encased in a woven stainless steel wrap that lends tensile and bursting strength to the tube. Before tube 18 is disposed in a tube-receiving portion 16 of sleeve member 12, a cylindrical steel retainer 22 is inserted into the end of tube 18. In addition, an environmental bushing 24 is disposed on the exterior of tube 18. A slide bushing 26 may be secured to the exterior of the stainless steel wrap 28 around tube 18, and tube 18 and wrap 28 are then inserted through the internal bore of a nut 30. Nut 30 can be slid along tube 18 away from the end thereof to facilitate the attachment of fitting 10 to tube 18.

Sleeve member 12 is secured onto the proximal end of signal transmission tube 18 by inserting tube 18 into tube-receiving portion 16 of sleeve member 12 and disposing the stainless steel wrap 28 outside of tube-receiving portion 16. Preferably, tube 18 is inserted into sleeve member 12 until it bears against internal shoulder 32. A crimp is then applied to tube-receiving portion 16 at a point concentric with retainer 22. Retainer 22 serves to prevent tube 18 from collapsing under the force of the crimp and also serves to increase the pressure between tube 18 and the crimped region of tube-receiving portion 16. A second crimp may be applied at a point concentric with environmental bushing 24 to establish an environmental seal between the exterior surface of tube 18 and the internal passage 14 of sleeve member 12. Thus, environmental contaminants such as moisture can be prevented from getting into internal passage 14 and from interfering with the function of fitting 10.

An initiating charge 38 comprising explosive material is secured to second end 13 of sleeve member 12. Part of initiating charge 38 is tamped into charge cavity 36 before an initiation means is secured onto sleeve member 12. The tamped portion of initiating charge 38 includes a primary charge 42 comprising lead azide which is disposed so that it can be detonated by the initiation means, e.g., by a signal emitted from signal transmission tube 18 through flange aperture 63. The tamped portion of initiating charge 38 also comprises a charge of high explosive 44 such as HNS which can be initiated by primary charge 42. To allow primary charge 42 and high explosive 44 to be tamped into charge cavity 36, a thin, rupturable membrane 46, which may consist of 0.5 mil fiberglass paper or the like, is applied over flange aperture 63. After primary charge 42 and high explosive 44 are tamped into charge-receiving portion 20, a metal cap 40 containing an additional charge 50 of high explosive is secured onto charge-receiving portion 20 by welding or by a suitable adhesive, or by other means known in the art.

Sleeve member 12 is dimensioned and configured to allow fitting 10 to be secured to a "connected device", e.g., to a rocket motor or to a signal transfer manifold. For example, sleeve member 12 may be provided with engagement means such as lugs (not shown) for engagement with the connected device in a bayonet-style coupling.

Alternatively, the sleeve member 12 may comprise an external shoulder 52 formed on sleeve member 12. Shoulder 52 may be engaged by a suitable catch device attached to the housing on the connected device. In the illustrated embodiment, the engagement means comprises shoulder 52 and an optional nut 30 that is rotatably mounted on sleeve member 12 and that has threads 54 that engage corresponding threads in an engagement portal in the housing of a connected device. The housing defines a recess dimensioned and configured to receive the second end 13 of fitting 10 therein when threads 54 of nut 30 engage the corresponding threads in the engagement portal. When nut 30 is screwed into an engagement portal, it bears on shoulder 52 to secure the second end 13 of sleeve member 12 in the recess.

The housing sealant means of fitting 10 comprises a housing bushing 56 and a bushing shoulder 58 formed within external ferrule 60. As described below in connection with FIG. 4, part of the connected device may be configured to bear against housing bushing 56 when the engagement means secures the fitting to the connected device. Together, housing bushing 56 and environmental bushing 24 provide an environmental seal between fitting 10 and the interior of the connected device. Housing bushing 56 may also help to secure metal cap 40 onto sleeve member 12 and to provide an environmental seal therebetween, thus protecting the explosive material disposed within metal cap 40 from contamination.

Figure 3:
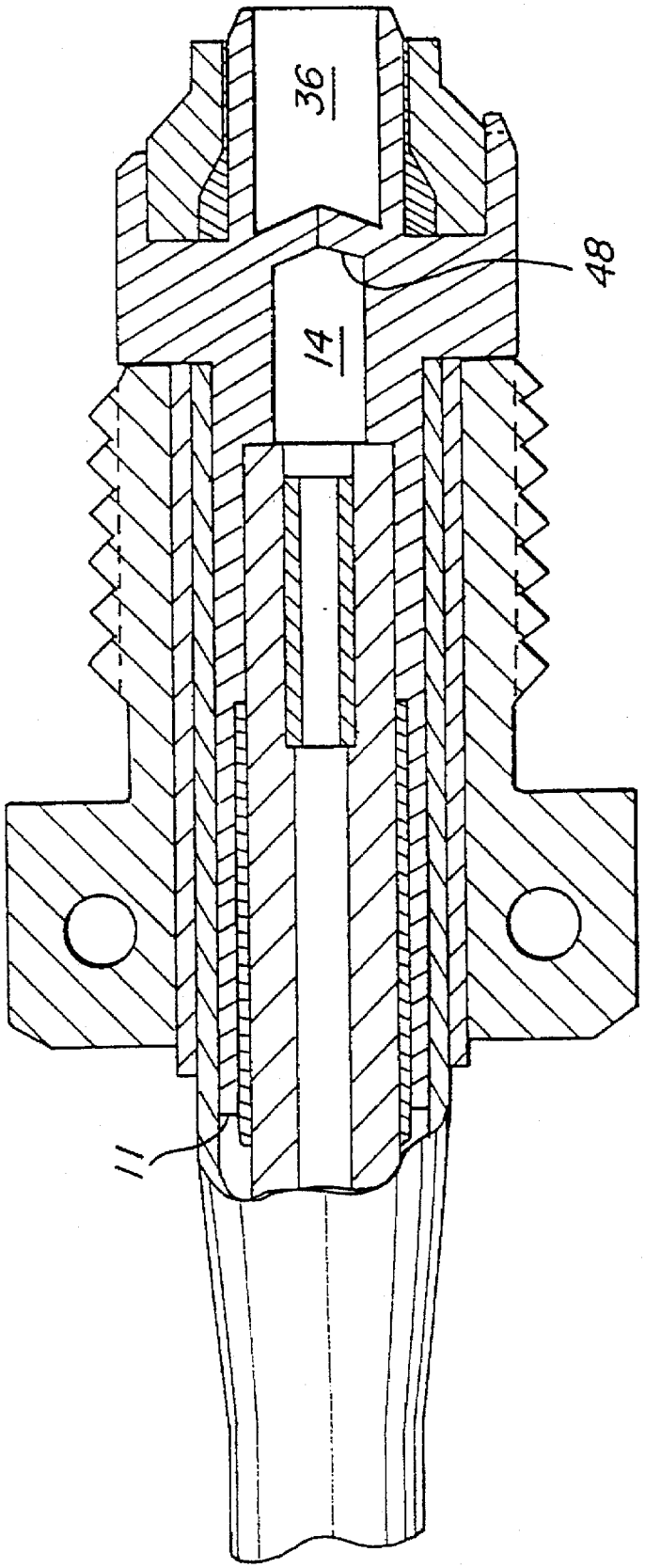
FIG. 3 is a cross-sectional view of the fitting of FIG. 2 showing the internal ferrule collapsed after detonation.

In accordance with the present invention, internal flange 48 protrudes into the charge cavity 36 and is surrounded by initiating charge 38, which resides in contact with the pressure-bearing surface 49. When initiating charge 38 detonates, it produces a pressure pulse of explosive gases that bears on pressure-bearing surface 49. Internal flange 48 is dimensioned and configured to be malleable so that it collapses into internal passage 14 under the force of the pressure pulse as indicated in FIG. 3. The collapsed flange obturates internal passage 14, thus hindering the explosive gases produced by initiating charge 38, and possibly from a connected device, from venting through sleeve member 12. By obturating internal passage 14, fitting 10 protects tube 18 against unintended rupture and hinders the dissipation therethrough of the energy produced by initiating charge 38, thus enhancing the efficiency with which a signal is transferred by the fitting to a connected device.

Figure 4:
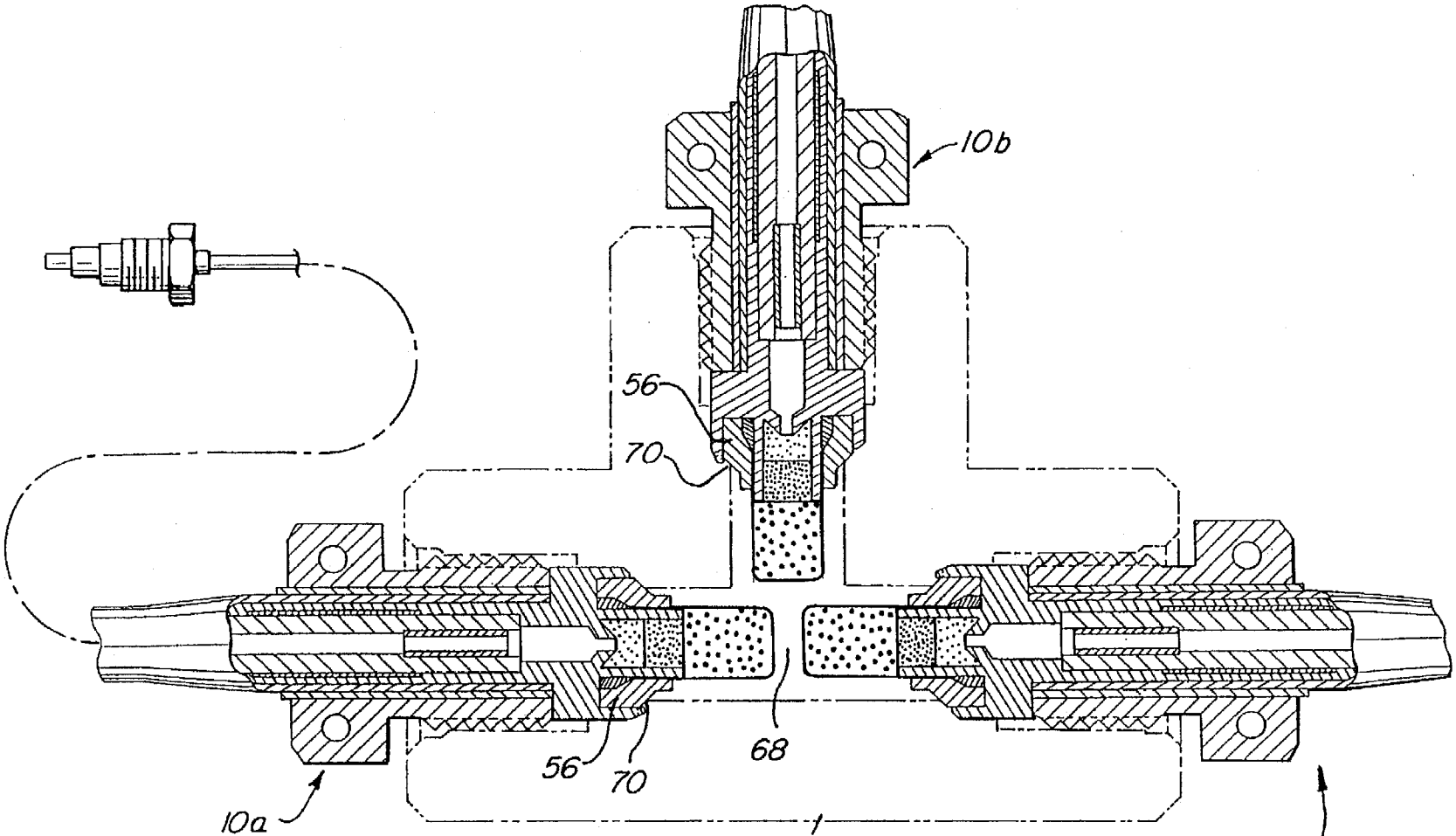
FIG. 4 is a cross-sectional view of a plurality of fittings as shown in FIG. 1 secured to a common manifold to allow signal transfer between them.

In FIG. 4, three fittings 10*a*, 10*b* and 10*c* in accordance with the present invention are secured to a coupling manifold 66 which positions fittings 10*a*, 10*b* and 10*c* so that their respective initiating charges are in mutual signal transfer relation with one another within a common recess 68. It will be noted that coupling manifold 66 defines shoulders such as shoulders 70 that bear against housing bushings 56 when nuts 30 fully engage manifold 66, thus sealing the interior of manifold 66. Thus, an initiation signal received from the signal tube of input fitting 10*a* will cause the associated primary charge to detonate, collapsing the internal flange of fitting 10*a* and initiating the initiating charges of output fittings 10*b* and 10*c*. The collapsed ferrule in fitting 10*a* will prevent a pressure pulse of explosive gases from venting into the associated signal transmission tube. Thus, the pressure pulse produced by the primary charge and the high explosive of the initiating charge will not be dissipated through fitting 10*a*, but instead will be more fully directed toward fittings 10*b* and 10*c*. The initiating charges of fittings 10*b* and 10*c* will initiate substantially simultaneously, each sending a shock wave signal that passes through the internal passage of its fitting to the associated fuse, thus producing outgoing signals in the fuses. The shock wave signals will be followed by pressure pulses that collapse the internal flanges of the fittings. Thus, even though an outgoing signal will be initiated in the fuses of fittings 10*b* and 10*c*, the fuses and any surrounding structures will be protected against exposure to a damaging pressure wave by the collapse of the internal flanges in those fittings. The fittings illustrated in FIG. 4 can therefore be described as bi-directional since the signal-initiating shock wave portion of an initiation signal can pass through them from the first end to the initiating charge (as for fitting 10*a*) or vice versa (as for fittings 10*b* and 10*c*). In either case, however, the internal flanges will collapse and hinder the passage of explosive gases from venting therethrough towards the first ends of the fittings. It will be noted that fitting 10*a* is part of an assembly comprising a signal transmission tube having a fitting secured to each end. Such an assembly is useful for connecting a triggering device to a coupling manifold through which several like devices may be initiated simultaneously.

In the foregoing embodiments, the initiation means for initiating the initiating charge comprised a signal transmission tube, e.g., shock tube or low velocity signal tube. An initiation signal can be initiated in such tubes by means well-known in the art. Optionally, a delay composition may be disposed in tube-receiving portion 16 between the end of the signal transmission tube 18 and the initiating charge, to interpose a delay between the issuance of an initiation signal from the signal transmission tube (or other initiation means) and the detonation of the initiating charge as described more fully below. In yet another embodiment of the invention, a mild detonating fuse may be used in place of the signal transmission tube. However, as indicated above, other initiation means may be associated with the sleeve member to initiate the initiating charge.

Figure 5A:
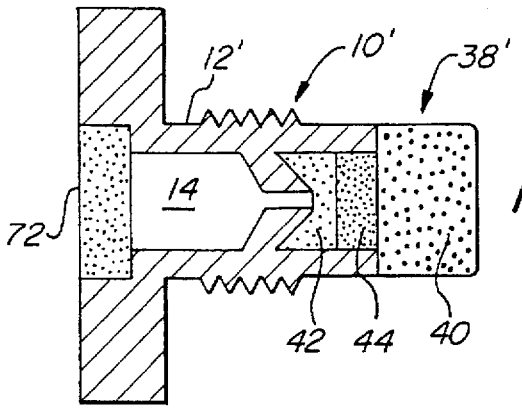
FIGS. 5A and 5B are cross-sectional views of obturating initiation fittings according to alternative embodiments of the present invention.

A fitting in accordance with still another embodiment of the present invention may be dimensioned and configured to be initiated by a pistol or other physical impact device. For example, the initiation means of the fitting 10' in FIG. 5A comprises a center-fire percussion cap 72 situated at the first end of sleeve member 12'. The impact of a pistol hammer on the center-fire percussion cap sets off the cap, and the resulting brisance passes through internal passage 14 and then sets off initiating charge 38'.

Figure 5B:
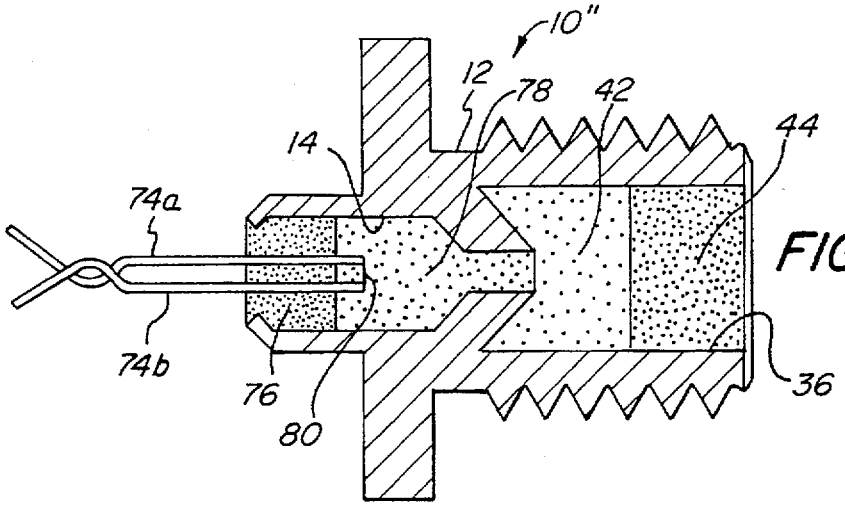

Yet another alternative embodiment of the invention is shown as fitting 10" in FIG. 5B. The sleeve member 12 of fitting 10" holds a tamped portion of an initiating charge that comprises a primary charge 42 and high explosive 44 within charge cavity 36. At the opposite end of the fixture, a bridge plug 76 secures a pair of lead wires 74*a*, 74*b* within sleeve member 12 with their ends extending into internal passage 14. Between bridge plug 76 and primary charge 42, internal passage 14 is filled with a bridge mix 78 that may comprise boron and ferric oxide, or lead styphnate or any other material sensitive to the detonation of a bridgewire and sufficiently brisant to initiate primary charge 42. The ends of lead wires 74*a* and 74*b* protrude into bridge mix 78 and are interconnected by a bridgewire 80. By sending an initiation signal via lead wires 74*a* and 74*b*, bridgewire 80 is initiated, which in turn initiates bridge mix 78. Bridge mix 78 then initiates primary charge 42 and fitting 10" proceeds to function in the same manner as other embodiments of the invention described above. Fitting 10" is not equipped to generate an electrical pulse in lead wires 74*a* and 74*b*, so fitting 10" is uni-directional, only allowing an initiation signal to be received via the lead wires 74*a* and 74*b* and to be emitted via the initiating charge comprising primary charge 42, high explosive 44, etc.

Figure 5C:
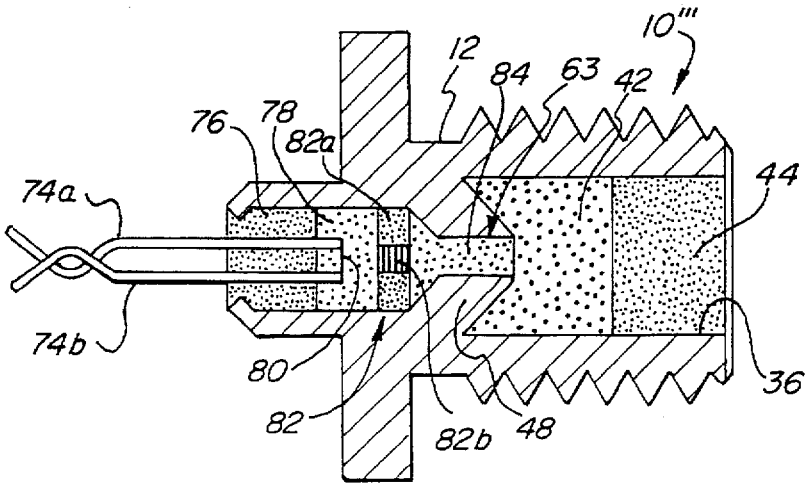
FIG. 5C is a cross-sectional view of a fitting similar to that of FIG. 5B, further including a delay element.

In any of the foregoing embodiments the fitting may optionally comprise a delay means for interposing a delay between receipt of an initiation signal and the initiation of the initiating charge. A delay means typically comprises a relatively slow-burning delay composition such as, e.g., a mixture of silicon and lead dioxide ($PbO_2$); silicon and red lead oxide ($Pb_3O_4$); silicon, red lead oxide and barium sulfate ($BaSO_4$), etc., that is ignited by the initiation means and serves to initiate an output charge. For example, FIG. 5C shows an initiation fitting 10''' comprising a delay element 82 comprising an annular lead sheath **82*a* within which is disposed a delay composition 82*b*. Such delay elements are well-known in the art for receiving a non-electric initiation signal and transferring the signal to an output charge after a predetermined delay. Delay element 82 receives an initiation signal from initiation means comprising bridgewire 80 and bridge mix 78. The signal travels relatively slowly through delay element 82 to a pyrotechnic transfer charge 84. Since transfer charge 84 is disposed within flange aperture 63 it preferably comprises a material that is substantially consumed and/or dispersed after initiation so that it leaves little or no residue to impede the collapse of flange 48. The pyrotechnic transfer charge material may optionally comprise the same material as bridge mix 78**.

While the invention has been described in detail with reference to particular embodiments thereof, it will be apparent that upon a reading and understanding of the foregoing, numerous variations to the described embodiments will occur to those skilled in the art and it is intended to include such variations within the scope of the appended claims.

What is claimed is:

1. An obturating initiation fitting comprising:

a sleeve member having a first end and a second end and defining an internal passage extending therethrough from the first end to the second end, the sleeve member being dimensioned and configured to be secured to a connected device;

an initiating charge disposed in the internal passage for producing an initiation signal comprising a signal-initiating shock wave and a pressure pulse of explosive gases;

initiation means disposed at the first end of the sleeve member for initiating the initiating charge; and obturating means for hindering the passage of the pressure pulse of explosive gases from the initiating charge to the first end of the sleeve member;

wherein the obturating means comprises a malleable flange in the sleeve member, the flange having a closure surface and protruding into the internal passage where the initiating charge is in juxtaposition with the closure surface, the flange being dimensioned and configured to collapse into the internal passage in response to detonation of the initiating charge.

2. The fitting of claim 1 wherein the obturating means is bi-directional with respect to a signal-initiating shock wave.

3. The fitting of claim 2 or claim 1, further comprising delay means between the initiation means and the initiating charge, for delaying the initiation of the initiating charge.

4. The fitting of claim 2 or 1, wherein the initiation means comprises a signal transmission tube having a proximal end secured to the first end of the sleeve member.

5. The fitting of claim 2 or 1, wherein the initiation means comprises a percussion cap.

6. The fitting of claim 2 or 1, wherein the initiation means comprises an electric bridgewire.

* * * * *

UNITED STATES PATENT AND TRADEMARK OFFICE

CERTIFICATE OF CORRECTION

PATENT NO. : 5,689,083

DATED : November 18, 1997

INVENTOR(S) : William C. Hadden

It is certified that error appears in the above-indentified patent and that said Letters Patent is hereby corrected as shown below:

In column 8, line 24 insert --claim-- after "claim 2 or".
In column 8, line 27 insert --claim-- after "claim 2 or".
In column 8, line 29 insert --claim-- after "claim 2 or".

Signed and Sealed this

Twenty-fourth Day of February, 1998

*Attest:*

Bruce Lehman

BRUCE LEHMAN

*Attesting Officer*

*Commissioner of Patents and Trademarks*